US008439597B2

(12) United States Patent
Diamond

(10) Patent No.: US 8,439,597 B2
(45) Date of Patent: May 14, 2013

(54) ASPHALT PAVING SEAM SEALER SYSTEM

(76) Inventor: Richard Diamond, Far Hills, NJ (US)

( * ) Notice: Subject to any disclaimer, the term of this patent is extended or adjusted under 35 U.S.C. 154(b) by 0 days.

(21) Appl. No.: 13/200,928

(22) Filed: Oct. 5, 2011

(65) Prior Publication Data

US 2013/0089374 A1 Apr. 11, 2013

(51) Int. Cl.
*E01C 11/02* (2006.01)

(52) U.S. Cl.
USPC ..... 404/54

(58) Field of Classification Search ..... 404/107, 404/47, 48, 37, 40, 53, 54; 52/584.1; 277/630, 277/637
See application file for complete search history.

(56) References Cited

U.S. PATENT DOCUMENTS

| | | | | | |
|---|---|---|---|---|---|
| 1,040,731 | A * | 10/1912 | Moore | 404/54 |
| 1,503,942 | A * | 8/1924 | Fischer | 404/65 |
| 2,283,787 | A * | 5/1942 | Brickman | 404/53 |
| 2,775,924 | A * | 1/1957 | Brickman | 404/53 |
| 2,796,624 | A * | 6/1957 | Speer | 16/16 |
| 3,292,330 | A * | 12/1966 | Tennison | 52/396.09 |
| 3,760,544 | A * | 9/1973 | Hawes et al. | 52/468 |
| 4,067,155 | A * | 1/1978 | Ruff et al. | 52/105 |
| 5,450,699 | A * | 9/1995 | Lee | 52/396.02 |
| 5,956,912 | A * | 9/1999 | Carter et al. | 52/396.02 |
| 5,981,061 | A | 11/1999 | Hegemann | |
| 6,289,645 | B1 * | 9/2001 | Schmid | 52/367 |
| 7,357,594 | B2 | 4/2008 | Takamura | |
| 7,478,781 | B2 * | 1/2009 | Granzeier et al. | 244/131 |
| 7,700,672 | B2 | 4/2010 | Partanen | |
| 2010/0021233 | A1 | 1/2010 | Chandler | |
| 2010/0316875 | A1 | 12/2010 | Lamon | |
| 2011/0135387 | A1 * | 6/2011 | Derrigan et al. | 404/69 |

* cited by examiner

*Primary Examiner* — Thomas B Will
*Assistant Examiner* — Abigail A Risic
(74) *Attorney, Agent, or Firm* — Thomas J. Germinario

(57) ABSTRACT

A new method of sealing the seam between two adjacent sections of asphalt pavement deploys an adhesive elastomeric gasket which completely envelopes the vertical faces of the adjacent lanes on three sides—i.e., above, below and along each face. Since the gasket extends partly underneath each section of paving, it is laid down before each lane is paved, thereby taking advantage of the heat of the fresh asphalt to effectively and rapidly cure the adhesive component of the gasket to insure a strong bond on both sides of the seam.

5 Claims, 4 Drawing Sheets

ASPHALT PAVING SEAM SEALER SYSTEM

BACKGROUND OF THE INVENTION

The present invention relates to the field of compositions and methods used in connection with the application, maintenance and repair of asphalt paving. More particularly, the present invention relates to methods and materials used in sealing seams in asphalt paving.

One of the major problems that arises in applying the top course paving of a roadway is the sealing of the joint or "seam" between pavement sections or "lanes". Since pavement sections are applied in widths determined by the width of the paver, they are typically applied in multiple passes of the paver, with each pass loosely referred to as a "lane". This means that there is time interval between paving one lane and the next adjacent lane, during which time the asphalt of the preceding lane has cooled to ambient temperature. The temperature difference between the cooled pavement of the preceding lane and the fresh asphalt of the next adjacent lane makes for a weak bond between the two sections along the seam. This weakness often leads to cracking in the seam area, which allows water to penetrate into the seam and, with freezing and thawing, produces progressive deterioration and separation of the pavement sections.

Even when a strong bond is initially achieved in the seam between lanes, the expansion and contraction of the adjacent lanes under varying weather conditions will subject the seam to stresses and shear forces that will tend to degrade the joint over time and cause it to fail, due to the limited elasticity and tensile strength of asphalt paving materials. In effect, a paving seam has to function as an "expansion joint" between adjacent lanes, but the asphalt concrete typically applied in the seam area does not have the right mechanical properties to serve this function.

In an effort to address the problems associated with seam sealing, two approaches have been tried. The first approach is to reheat an area of the previously cooled lane adjacent to the seam to approximately the same temperature as the hot asphalt applied to the new lane, so that the reheated area will fuse with the fresh paving. An example of this method is taught by the patent application of Chandler (US2010/0021233). But the limited extent to which applied heat can penetrate downward and laterally into the asphalt of the preceding lane means that there will always be some juncture along which hot asphalt is interfacing with cooled asphalt, thereby producing a deficient bond.

The second approach to the seam sealing dilemma involves the use of a joint-sealing tape. Such tapes typically comprise a mixture of soft asphalt and rubber, and they are inserted into the seam after the two adjoining pavement sections have been laid down. An example of this method is described in the Hegemann U.S. Pat. No. 5,981,061. Problems associated with this method include gaps between the tape and the asphalt and failure of the tape to penetrate deeply enough into the seam. Furthermore, since this method involves applying adhesive between two pavement sections at ambient temperature, it misses the opportunity to use the elevated temperature of the fresh hot asphalt to improve the curing of the adhesive so as to form a stronger bond.

The present invention introduces a new method of sealing the seam between two adjacent sections of asphalt pavement. Instead of a tape applied after the adjoining sections have been paved, the present invention deploys an adhesive elastomeric gasket which completely envelopes the vertical faces of the adjacent lanes on three sides—i.e., above, below and along each face. Since the gasket extends partly underneath each section of paving, it is laid down before each lane is paved, thereby taking advantage of the heat of the fresh asphalt to effectively and rapidly cure the adhesive component of the gasket to insure a strong bond on both sides of the seam.

SUMMARY OF THE INVENTION

The present invention comprises a gasket "carpet" that is laid down prior to the paving of the initial section or lane of a roadway. An example of such a gasket is shown in FIG. 3. The gasket 10 comprises a footing sheet 13, a seam wall 14, and two top flanges 15 16, which together constitute an integral whole. As exemplified in FIG. 1, the footing sheet 13 is placed so as to extend across the seam between adjoining sections 11 12 and also to extend partly under each of the adjoining sections. The footing sheet 13 is a horizontal rectangular sheet, which is flat or, as depicted in FIG. 1, is slightly convex on its lower side with tapering ends. The seam wall 14 occupies the seam between the first pavement section 11 and the second pavement section 12. The seam wall 14 is an upright rectangular sheet, which merges at the bottom into the footing sheet 13. At the top, the seam wall 14 is hingeably attached to the first top flange 15 by a first hinge means 17 and to the second top flange 16 by a second hinge means 18.

The first and second hinge means 17 18 preferably comprise a flexible strip of the same elastomeric material from which the entire gasket 10 is fabricated. Each of the two top flanges 15 16 is a rectangular sheet, which is flat or, as depicted in FIG. 1, is slightly convex on its upper side with tapered ends. As depicted in FIGS. 2A through 2D, the top flanges 15 16 are initially turned upward before the pavement sections are laid over the footing sheet 13. After the first pavement section 11 is laid down, the first top flange 15 is turned down about the first hinge means 17 to enclose the top corner of the first pavement section 11. After the second pavement section 12 is laid down, the second top flange 16 is turned down about the second hinge means 18 to enclose the top corner of the second pavement section 12.

The gasket 10 is made of a water-impermeable elastomeric material that is resistant to environmental extremes of temperature and humidity and can withstand prolonged exposure to heat, cold, ozone, ultra-violet radiation, and hydrocarbons. The gasket elastomer must also must have high tensile and tear strength and remain flexible under compression and elongation over a broad temperature range. Preferred gasket materials are nitrile butadiene rubber (NBR), hydrogenated nitrile butadiene rubber (HNBR), and/or hydrogenated carboxylated nitrile butadiene rubber (HXNBR). In order to increase its adhesiveness and protect it from oxidative and chemical degradation, the contact surfaces of the gasket 10 is coated with an adhesive resin 19 (FIG. 3) having the same mechanical properties enumerated above. Suitable adhesive resins are epoxy resins and/or silicone resins, as well as silicone-epoxy hybrid polymers and epoxy-modified polysiloxanes. The adhesive-coated contact surfaces, as shown in FIG. 3, are the top surfaces of the footing sheet 13, the side walls of the seam wall 14, and the bottom surfaces of the two top flanges 15 16.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 2A:
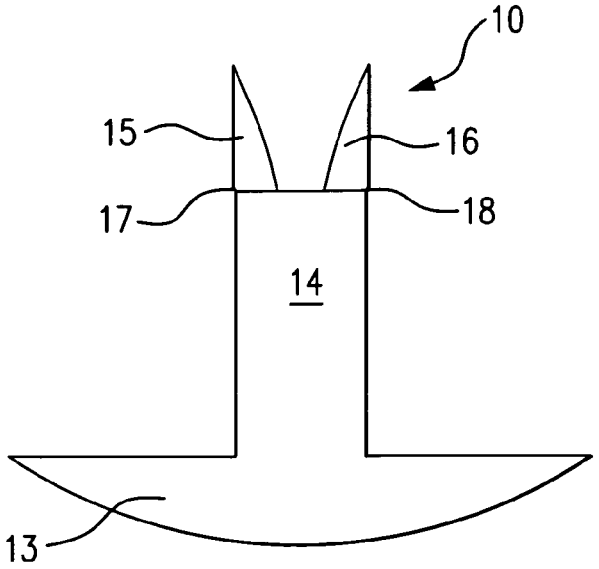
FIGS. 2A-2D are a series of front elevation views of the preferred embodiment of the present invention, showing the steps of installing the gasket in the seam between two adjoining pavement sections.
Figure 3:
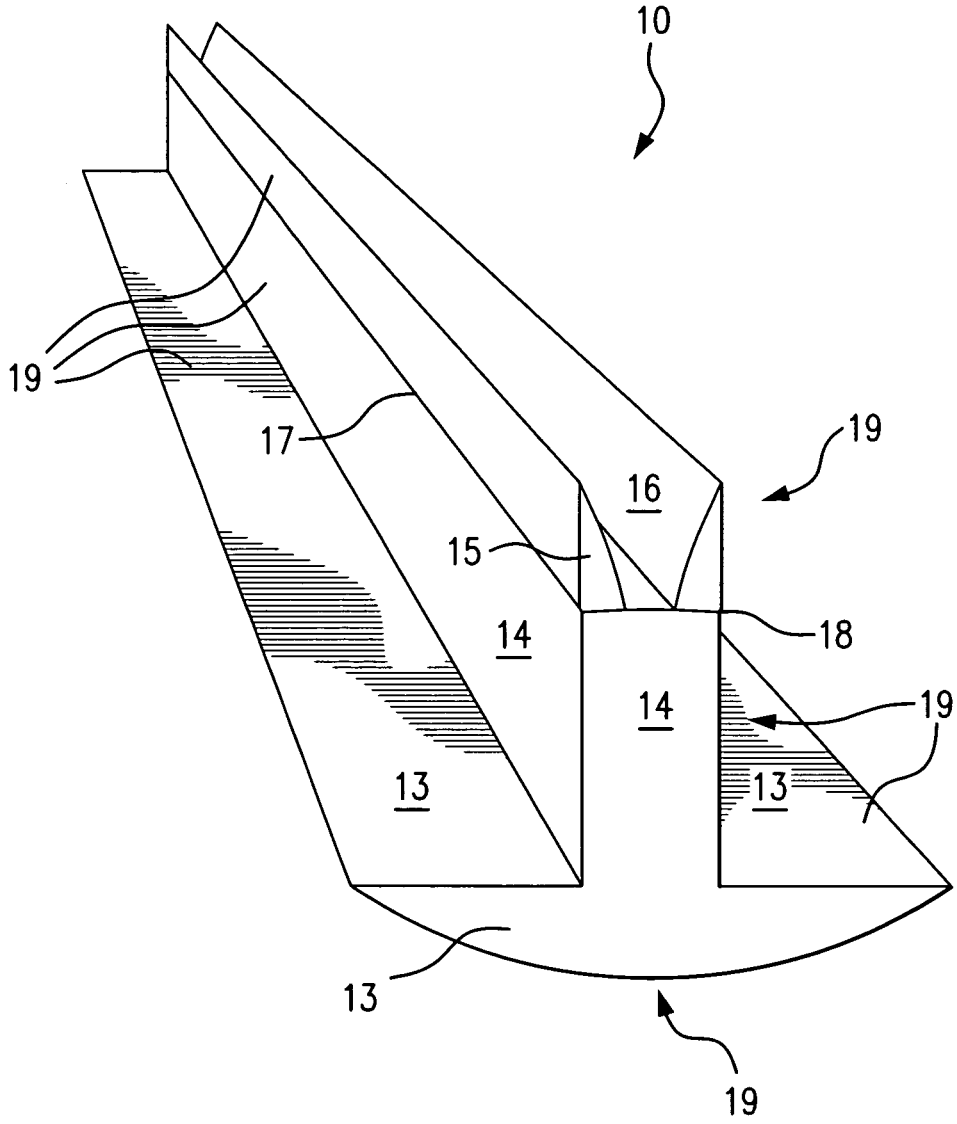
FIG. 3 is a front perspective view of the preferred embodiment of the present invention.

As shown in FIG. 2A, the gasket 10 is initially positioned with the footing sheet 13 resting on the surface to be paved, and the seam wall 14 in an upright position. Both of the top flanges 15 16 are also initially turned on the hinges 17 18 so as to point upward, so as not to obstruct the paving on either side of the seam wall 14. As illustrated in FIG. 3, the gasket 10 is initially rolled out in this configuration along the length of the road to be paved, with the seam wall 14 aligned with the joint between the first and second pavement sections 11 12. The tapered concave bottom surface of the footing sheet 13 provides a gradual elevation transition from the paved lane to the seam and can be used to achieve a raised "crown" along the seam, if appropriate.

Figure 2B:
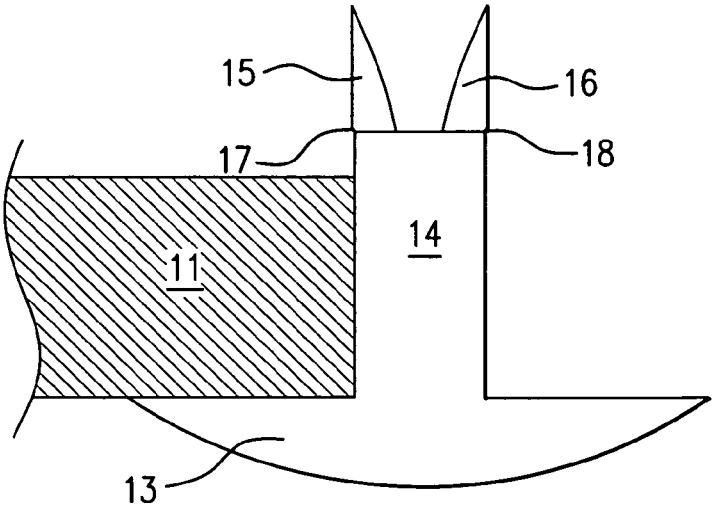
Figure 2C:
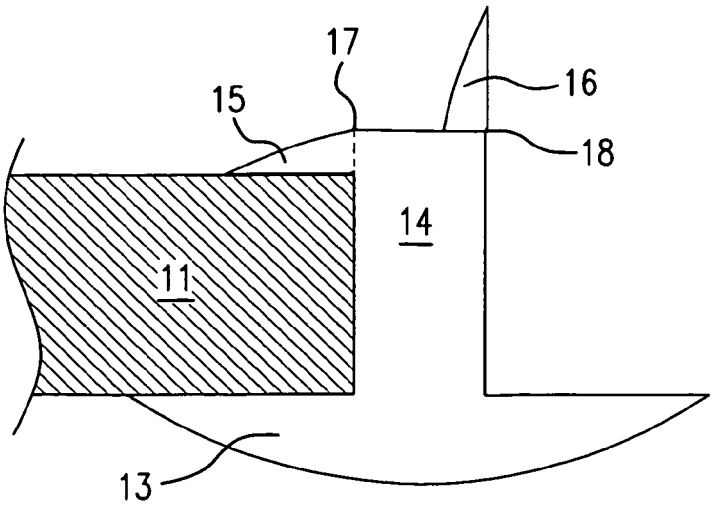

Next, as depicted in FIG. 2B, the first pavement section 11 is laid down over one side of the footing sheet 13. The hot asphalt of the first lane 11 bonds with the adhesive resin coating 19 (FIG. 3) along the upper surface of the footing sheet 13 and along the first side of the seam wall 14. After the first pavement section 11 has been laid down, and while the asphalt is still hot, the first top flange 15 is turned down about its hinge 17, as shown in FIG. 2C, and the adhesive coating 19 on its lower surface bonds with the upper surface of the asphalt.

Figure 1:
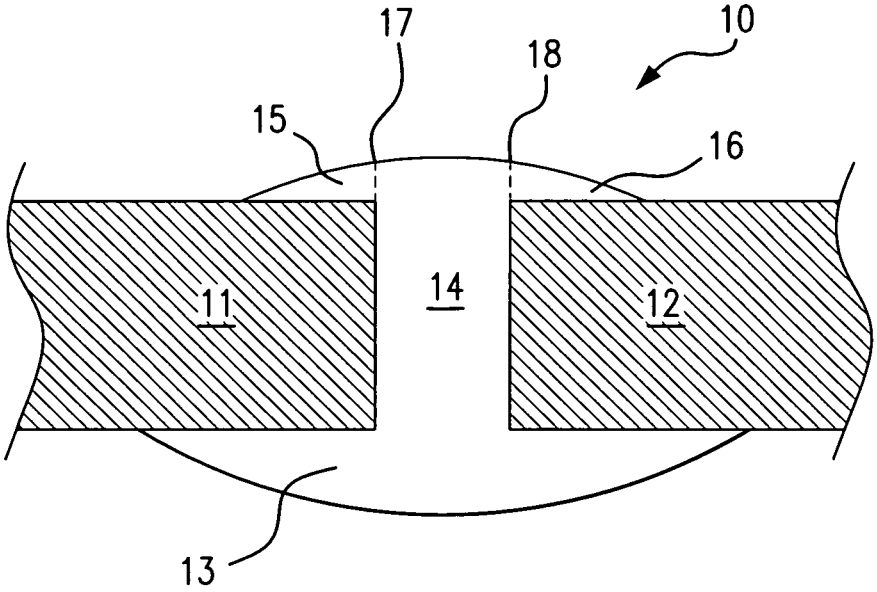
FIG. 1 is a front elevation view of the preferred embodiment of the present invention.
Figure 2D:
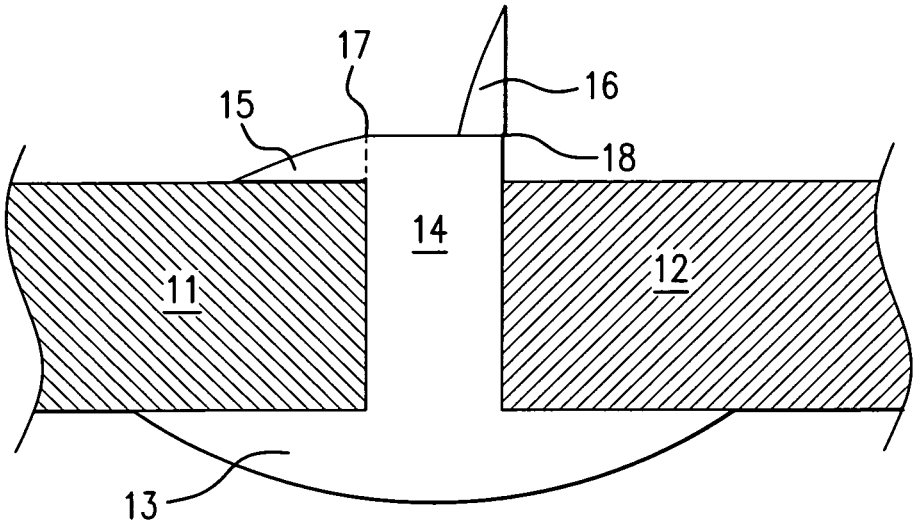

The foregoing process is repeated when the second pavement section 12 is laid down over the other side of the footing sheet 13, as depicted in FIG. 2D. The hot asphalt of the second lane 12 bonds with the adhesive resin coating 19 along the upper surface of the footing sheet 13 and along the second side of the seam wall 14. After the second pavement section 11 has been laid down, and while the asphalt is still hot, the second top flange 16 is turned down about its hinge 18, as depicted in FIG. 1, and the adhesive coating 19 on its lower surface bonds with the upper surface of the asphalt.

The resulting configuration of the gasket 10, as shown in FIG. 1, completely seals and bonds together the adjoining ends of the two pavement sections 11 12 on all three sides—top, bottom and facing edges—thereby preventing penetration of moisture from all directions. The flexible elastic material of the gasket 10, preferably HNBR or HXNBR rubber, and the adhesive resin coating 19, preferably silicone-epoxy polymer, along with the mechanical strength of the gasket and adhesive constituents, enables the adhesive gasket 10 to effectively function as an "expansion joint" to prevent seam failure/cracking during cyclical expansion and contraction of the adjacent pavement sections.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. An adhesive elastomeric gasket for sealing a seam between two adjoining vertical faces of two adjacent sections of asphalt pavement, comprising:

a vertical wall member having a top surface, a first side surface, a second side surface, and a lower section;

a horizontal footing member extending from the lower section of the wall member and having a first upper surface, a second upper surface, and a lower surface;

a first top flange, having a top surface and a bottom surface, which first top flange is hingeably attached between the top surface and the first side surface of the wall member, such that the first top flange can be non-deformably turned about a first hinge means either to an upright position, extending upward from the top surface of the wall member, or to a lateral position, extending outward from the first side surface of the wall member;

a second top flange having a top surface and a bottom surface, which second top flange is hingeably attached between the top surface and the second side surface of the wall member, such that the second top flange can be non-deformably turned about a second hinge means either to an upright position, extending upward from the top surface of the wall member, or to a lateral position, extending outward from the second side surface of the wall member;

an elastic adhesive coating applied to the first side surface and the second side surface of the wall member, and to the first upper surface and the second upper surface of the footing member, and to the bottom surfaces of the first top flange the second top flange;

wherein the wall member extends through the entire length of the seam and adhesively engages the entire lengths of the two adjoining vertical faces of the two adjacent sections of asphalt pavement along the first side surface and the second side surface of the wall member;

wherein the footing member extends across the seam and beneath the two adjoining vertical faces of the two adjacent sections of asphalt pavement and adhesively engages the two adjacent sections of asphalt pavement from below along the first upper surface and the second upper surface of the footing member;

wherein the first top flange in its upright position and the second top flange in its upright position extend vertically upward from the top surface of the wall member, such that no portion of the bottom surfaces of the first top flange or the second top flange engage the two adjacent sections of asphalt pavement;

wherein the first hinge means does not resiliently deform so as to urge the first top flange toward the lateral position from the upright position or toward the upright position from the lateral position, and wherein the second hinge means does not resiliently deform so as to urge the second top flange toward the lateral position from the upright position or toward the lateral position from the upright position; and wherein the first top flange in its lateral position and the second top flange in its lateral position extend over the two adjoining vertical faces of the two adjacent sections of asphalt pavement and adhesively engage the two adjacent sections of asphalt paving from above along the bottom surfaces of the first top flange and the second top flange.

2. The adhesive elastomeric gasket according to claim 1, wherein the lower surface of the footing member is convex with tapered ends.

3. The adhesive elastomeric gasket according to claim 2, wherein the top surface of the wall member and the top surfaces of the first top flange and the second top flange are complementary convex sections that together form a continuous convex surface when the first top flange and the second top flange are in their lateral positions.

4. The adhesive elastomeric gasket according to claim 3, wherein the gasket is made of a nitrile butadiene rubber.

5. The adhesive elastomeric gasket according to claim 4, wherein the elastic adhesive coating is a silicone-epoxy polymer on an epoxy-modified polysiloxane.

* * * * *